US012305416B2

(12) United States Patent
Bibby

(10) Patent No.: US 12,305,416 B2
(45) Date of Patent: May 20, 2025

(54) TENT STAKE ASSEMBLY

(71) Applicant: Rosanne Bibby, Scarborough (CA)

(72) Inventor: Rosanne Bibby, Scarborough (CA)

( * ) Notice: Subject to any disclaimer, the term of this patent is extended or adjusted under 35 U.S.C. 154(b) by 181 days.

(21) Appl. No.: 18/128,423

(22) Filed: Mar. 30, 2023

(65) Prior Publication Data

US 2024/0328191 A1 Oct. 3, 2024

(51) Int. Cl.
*E04H 15/62* (2006.01)

(52) U.S. Cl.
CPC ..... *E04H 15/62* (2013.01)

(58) Field of Classification Search
CPC ..... E04H 15/62; E04H 12/2215
USPC ..... 135/118
See application file for complete search history.

(56) References Cited

U.S. PATENT DOCUMENTS

| | | | | |
|---|---|---|---|---|
| 227,675 | A * | 5/1880 | Carnes et al. | A01K 1/04 119/780 |
| 2,087,176 | A * | 7/1937 | Webb | A01K 1/04 119/787 |
| 2,154,966 | A * | 4/1939 | Vanderveer | G01C 15/04 411/452 |
| 3,456,660 | A | 7/1969 | Borchardt | |
| 3,635,232 | A | 1/1972 | Rotheiser | |
| 4,185,424 | A | 1/1980 | Streit | |
| 5,101,525 | A * | 4/1992 | Ippolito | E04H 15/62 135/118 |
| D377,076 | S | 12/1996 | Adams | |
| 6,938,384 | B1 | 9/2005 | Hodge | |
| D658,259 | S | 4/2012 | Zhou | |
| 9,080,587 | B1 * | 7/2015 | Smith | A63C 19/00 |
| 10,260,252 | B2 | 4/2019 | Boswell | |
| 10,352,064 | B2 * | 7/2019 | Gilmer | E04H 15/62 |
| D890,449 | S | 7/2020 | Gilmer | |
| 11,851,904 | B2 * | 12/2023 | Xian | E04H 15/62 |
| 2007/0235602 | A1 * | 10/2007 | Gross | E04H 12/2215 248/156 |

FOREIGN PATENT DOCUMENTS

| | | |
|---|---|---|
| WO | WO2006079140 | 8/2006 |

* cited by examiner

*Primary Examiner* — Noah Chandler Hawk

(57) ABSTRACT

A tent stake assembly for securing a tent includes a tent stake that has a tapered end which tapers to a point to penetrate ground. A head is attached to the tent stake such that the head defines a striking surface which can be struck by a tool for driving the tent stake into the ground. The head is distally positioned with respect to the tapered end of the tent stake. The head has a plurality of gripping elements each extending downwardly from the head to engage the ground when the tent stake is driven into the ground. In this way the gripping elements inhibiting the tent stake from rotating in the ground.

5 Claims, 6 Drawing Sheets

TENT STAKE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to stake devices and more particularly pertains to a new stake device that is inhibited from rotating in the ground when the tent stake is employed for anchoring a tent. The device includes a tent stake that has a plurality of ridges extending outwardly from the tent stake thereby inhibiting the tent stake from rotating in the ground. The device includes a head attached to the tent stake which defines a striking surface for driving the tent stake into the ground. The device includes a head that has a plurality of gripping elements which engage the ground to inhibit the tent stake from rotating in the ground.

(2) Description of Related Art Including Information Disclosed Under 37 CFR 1.97 and 1.98

The prior art relates to stake devices including a variety of stake devices that includes a steak with a plurality of ridges and a head defining a striking surface. The prior art discloses a beach blanket stake that includes a head defining a striking surface and a lanyard extending away from the stake. The prior art discloses a variety of stake devices that each includes hooking elements that extend downwardly along the stake for attaching anchoring lines. The prior art discloses an anchoring stake that includes a plurality of barbs and a head defining a striking surface.

BRIEF SUMMARY OF THE INVENTION

An embodiment of the disclosure meets the needs presented above by generally comprising a tent stake that has a tapered end which tapers to a point to penetrate ground. A head is attached to the tent stake such that the head defines a striking surface which can be struck by a tool for driving the tent stake into the ground. The head is distally positioned with respect to the tapered end of the tent stake. The head has a plurality of gripping elements each extending downwardly from the head to engage the ground when the tent stake is driven into the ground. In this way the gripping elements inhibit the tent stake from rotating in the ground.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
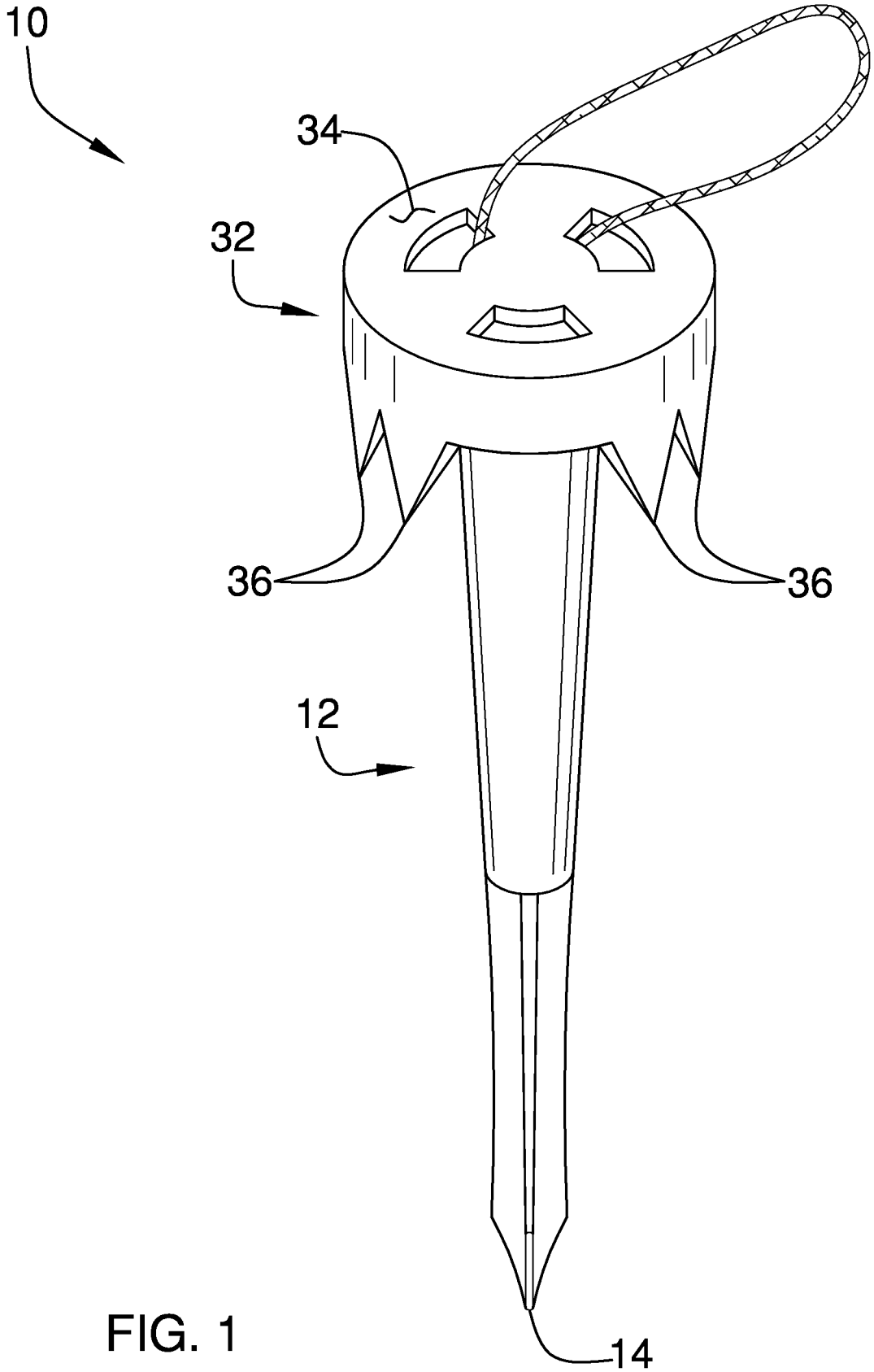
FIG. 1 is a top perspective view of a tent stake assembly according to an embodiment of the disclosure.
Figure 2:
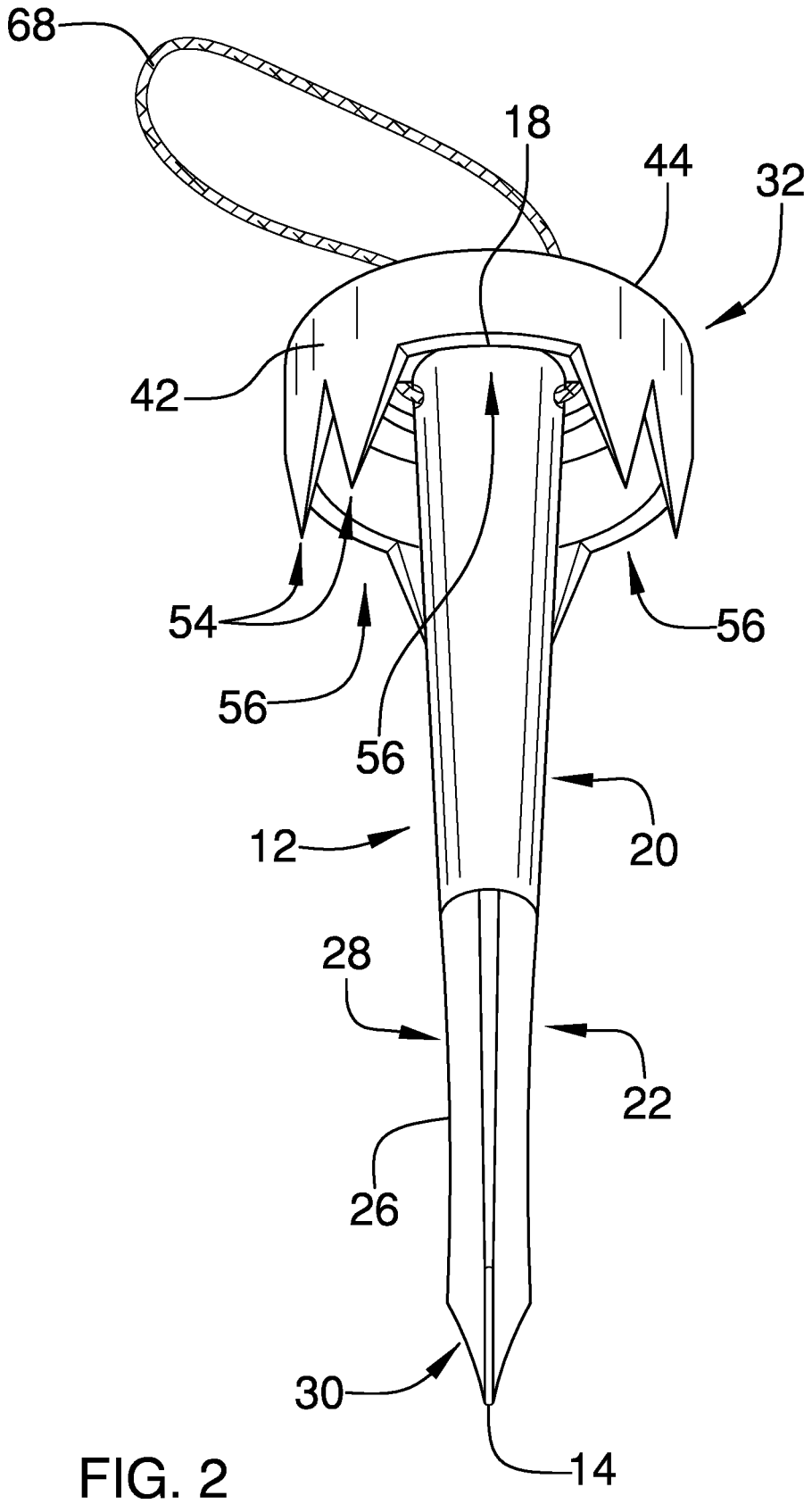
FIG. 2 is a bottom perspective view of an embodiment of the disclosure.
Figure 3:
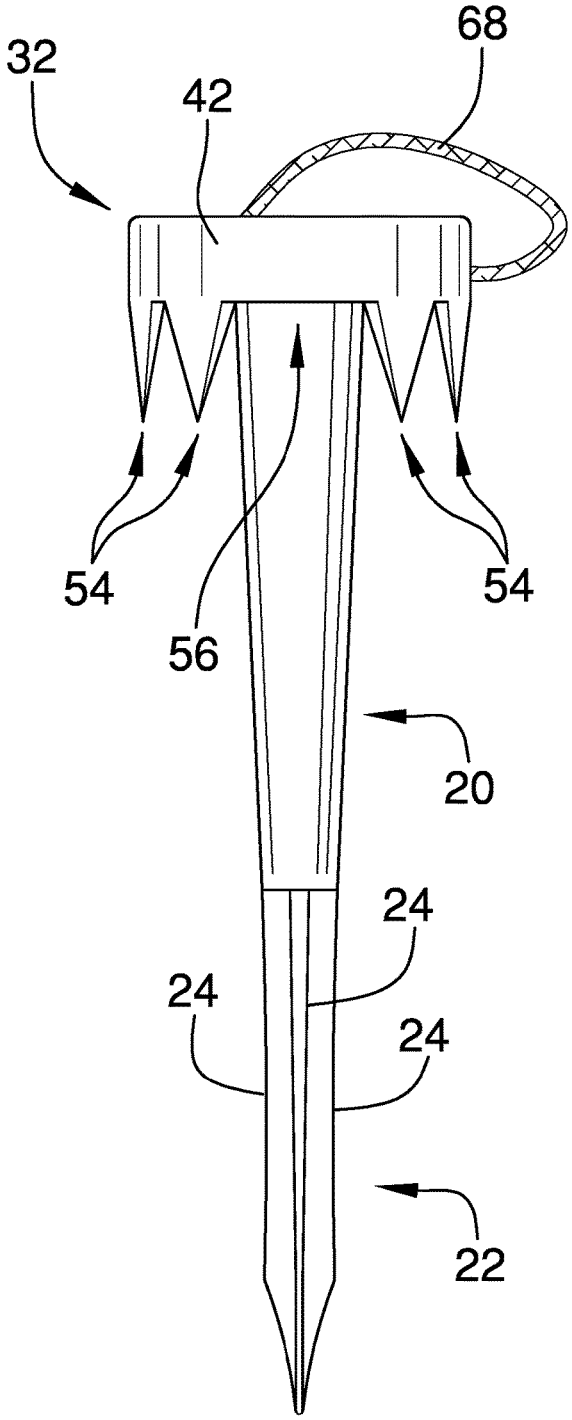
FIG. 3 is a front view of an embodiment of the disclosure.
Figure 4:
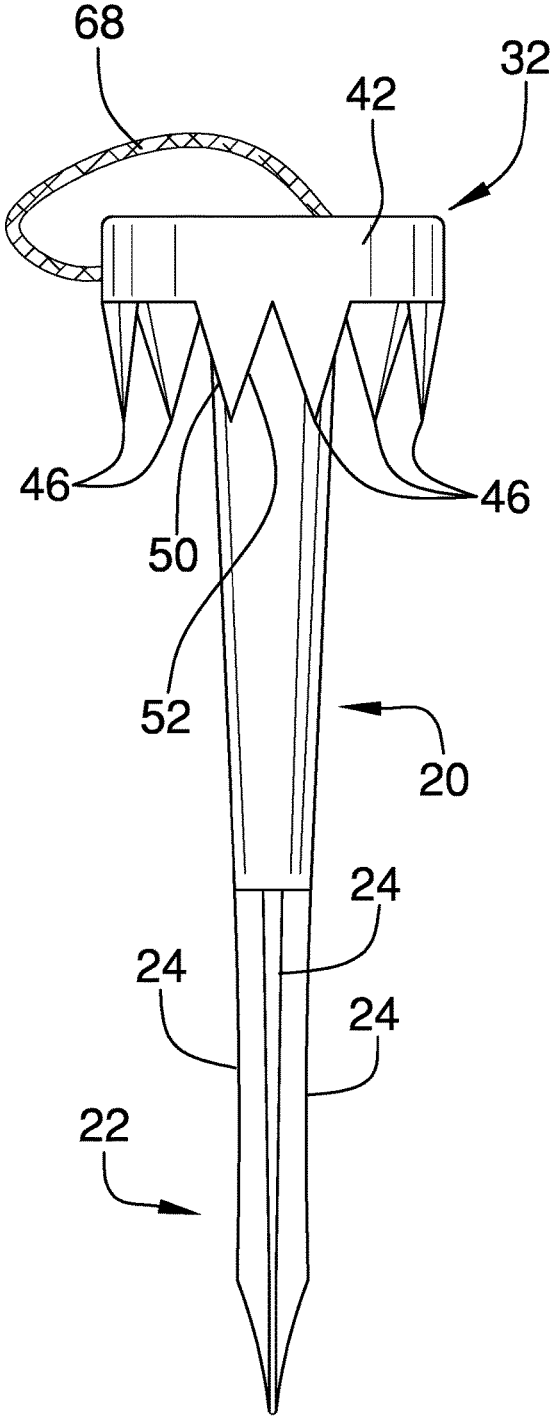
FIG. 4 is a back view of an embodiment of the disclosure.
Figure 5:
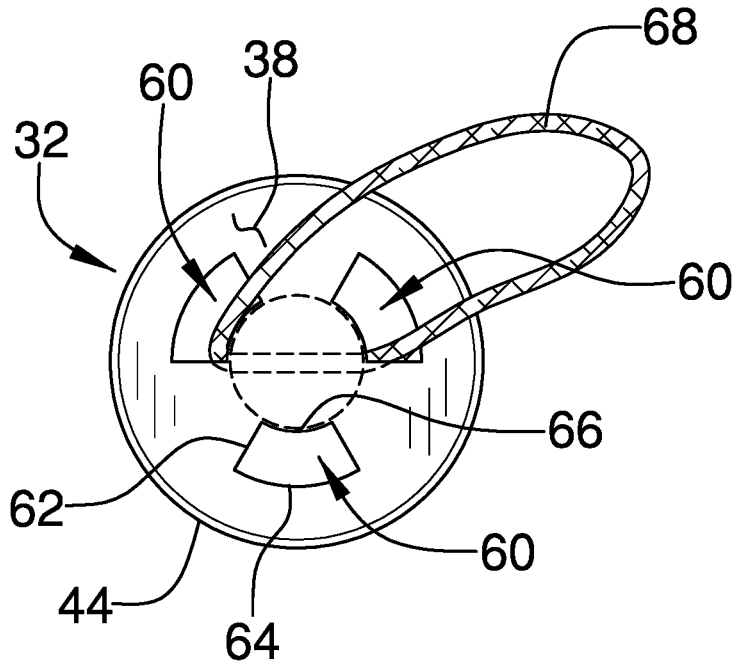
FIG. 5 is a top view of an embodiment of the disclosure.
Figure 6:
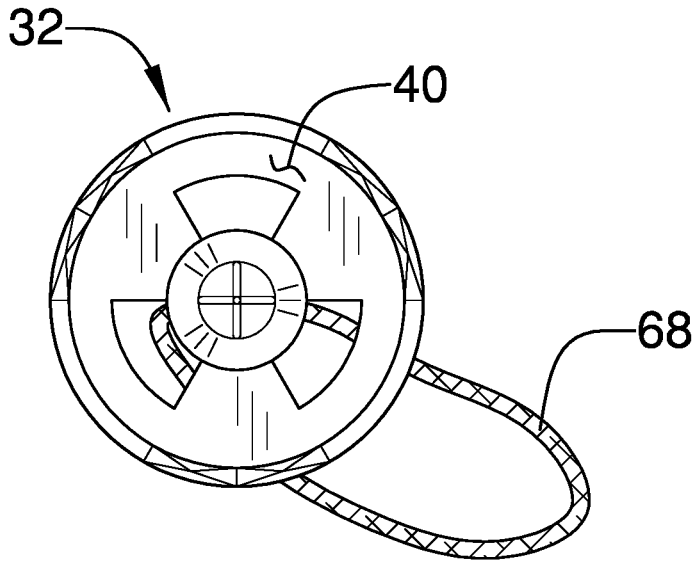
FIG. 6 is a bottom view of an embodiment of the disclosure.

With reference now to the drawings, and in particular to FIGS. 1 through 8 thereof, a new stake device embodying the principles and concepts of an embodiment of the disclosure and generally designated by the reference numeral 10 will be described.

As best illustrated in FIGS. 1 through 8, the tent stake assembly 10 generally comprises a tent stake 12 that has a tapered end 14 which tapers to a point thereby facilitating the tapered end 14 to penetrate ground 16. The tent stake 12 has a distal end 18 with respect to the tapered end 14 and the tent stake 12 has an upper portion 20 and a lower portion 22. The upper portion 20 is associated with the distal end 18 and the lower portion 22 is associated with the tapered end 14. Additionally, the upper portion 20 of the tent stake 12 flares outwardly between the lower portion 22 of the tent stake 12 and the distal end 18 of the tent stake 12.

The lower portion 22 has a plurality of ridges 24 each extending outwardly from the tent stake 12 and each of the plurality of ridges 24 extends between the tapered end 14 and the upper portion 20. The ridges 24 are evenly spaced apart from each other and are distributed around the lower portion 22. Furthermore, the plurality of ridges 24 inhibits the tent stake 12 from rotating about an axis extending between the tapered end 14 and the distal end 18 when the tent stake 12 is driven into the ground 16. Each of the ridges 24 has an outwardly facing edge 26 and the outwardly facing edge 26 of each of the ridges 24 has a first section 28 and a second section 30. Each of the first section 28 and the second section 30 curve outwardly from the lower portion 22 and intersect each other at a point that is spaced from the tapered end 14. The second section 30 of the outwardly facing edge 26 of each of the ridges 24 intersects the tapered end 14.

A head 32 is attached to the tent stake 12 such that the head 32 defines a striking surface 34 which can be struck by a tool for driving the tent stake 12 into the ground 16 and the head 32 is distally positioned with respect to the tapered end 14 of the tent stake 12. The head 32 has a plurality of gripping elements 36 each extending downwardly from the head 32 to engage the ground 16 when the tent stake 12 is driven into the ground 16. In this way the gripping elements 36 inhibit the steak from rotating when the tent stake 12 is driven into the ground 16. The head 32 has a top surface 38, a bottom surface 40 and a lip 42 extending downwardly from a perimeter edge 44 of the head 32. The distal end 18 of the tent stake 12 is attached to the bottom surface 40 such that the top surface 38 of the head 32 defines the striking surface 34. Additionally, the distal end 18 of the tent stake 12 is centrally positioned on the bottom surface 40 such that the lip 42 extends around the tent stake 12.

The head 32 has a plurality of teeth 46 each extending downwardly from a bottom edge 48 of the lip 42 such that the plurality of teeth 46 defines the plurality of gripping elements 36. Each of the teeth 46 has a first edge 50 and a second edge 52 each extending downwardly from the bottom edge 48 of the lip 42 and intersecting each other at a point. The teeth 46 are arranged into a plurality of sets of teeth 54; the sets of teeth 54 are evenly spaced apart from each other and are distributed around the bottom edge 48 of the lip 42 to define a plurality of spaces 56 between the sets of teeth 54. Furthermore, respective ones of the plurality of spaces 56 accommodate a guy wire 58 that is wrapped around the tent stake 12 thereby facilitating the tent stake 12 to anchor the guy wire 58 when the tent stake 12 is driven into the ground 16.

The head 32 has a plurality of holes 60 each extending through the top surface 38 and the bottom surface 40 and each of the plurality of holes 60 is positioned between the distal end 18 of the tent stake 12 and the lip 42. The holes 60 are evenly spaced apart from each other and are distributed around the tent stake 12. Each of the holes 60 has a bounding edge 62 which has a front side 64 and a back side 66 and each of the front side 64 and the back side 66 defines a circular arc that is co-arcuate with each other such that each of the holes 60 has a curved rectangular shape. A lanyard 68 extends through the upper portion 20 of the tent stake 12 at a point located adjacent to the distal end 18. The lanyard 68 extends outwardly through a respective pair of the holes 60 in the head 32 and the lanyard 68 forms a closed loop thereby facilitating the lanyard 68 to be gripped for pulling the tent stake 12 outwardly from the ground 16.

Figure 7:
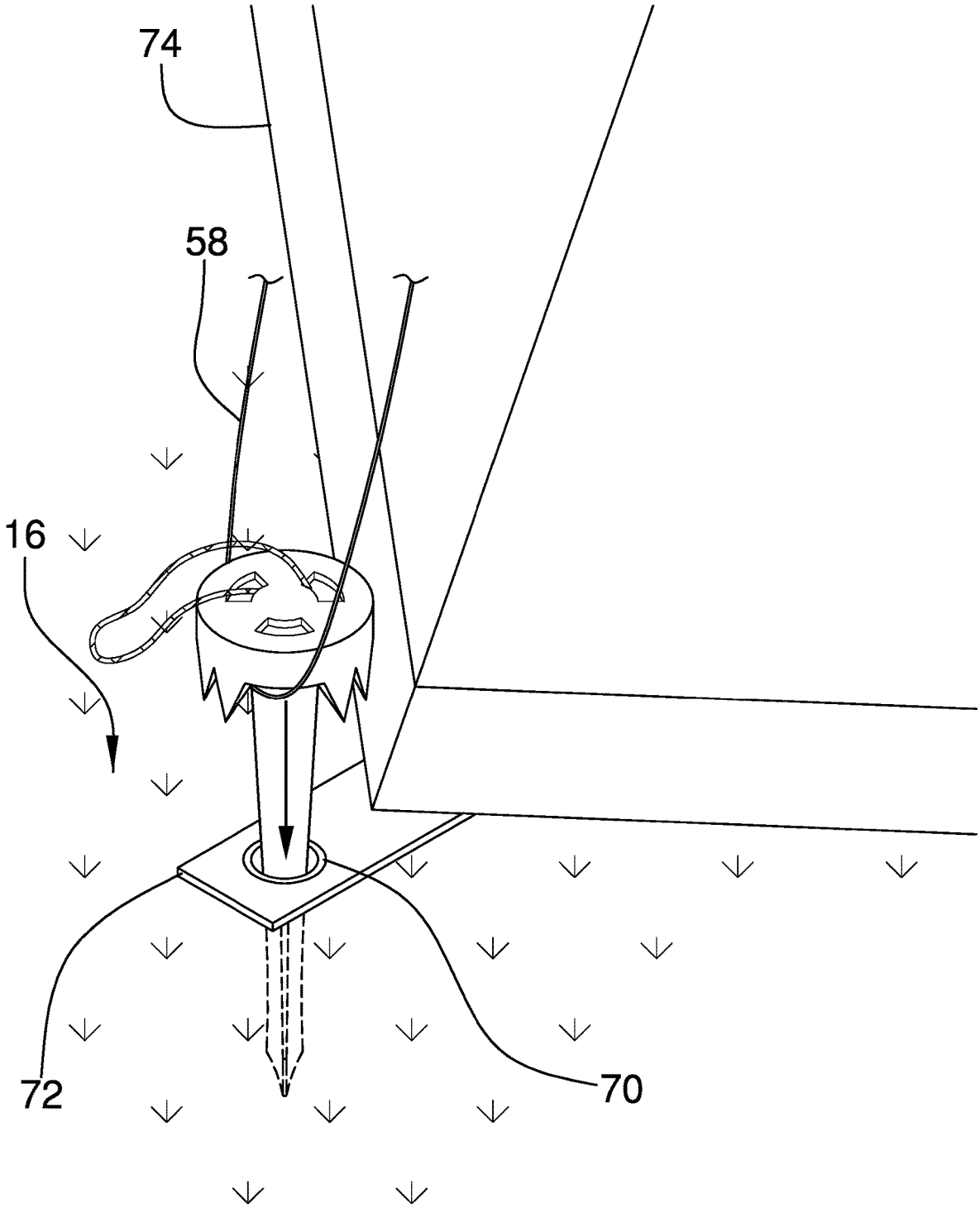
FIG. 7 is a perspective in-use view of an embodiment of the disclosure.
Figure 8:
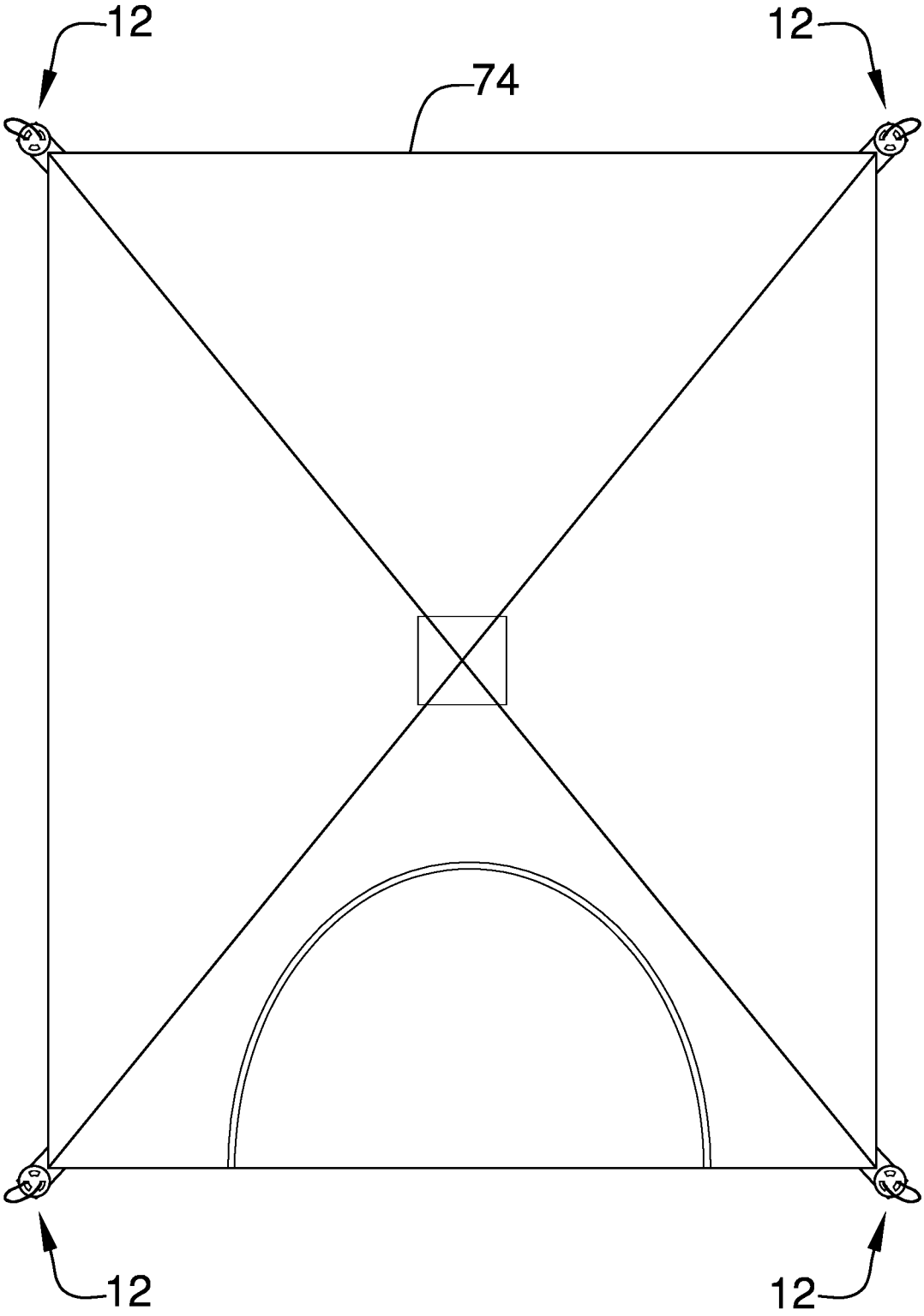
FIG. 8 is a top perspective in-use view of an embodiment of the disclosure.

In use, as is most clearly shown in FIGS. 7 and 8, the tent stake 12 is extended through a hole 70 in a securing flap 72 of a tent 74 and the tent stake 12 is driven into the ground 16 to anchor the tent 74 to the ground 16. Furthermore, the plurality of ridges 24 and the plurality of teeth 46 inhibit the tent stake 12 from rotating in the ground 16 thereby reducing the likelihood that the tent stake 12 will become dislodged. The guy wire 58 can be wrapped around the tent stake 12 prior to driving the tent stake 12 into the ground 16 and the guy wire 58 can be positioned in respective spaces 56 between the sets of teeth 54 when the tent stake 12 is driven into the ground 16. The lanyard 68 is gripped to facilitate the tent stake 12 to be removed from the ground 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tent stake assembly for resisting being rotated or pulled from the ground while securing a tent, said assembly comprising:

a tent stake having a tapered end which tapers to a point wherein said tapered end is configured to penetrate ground;

a head being attached to said tent stake such that said head defines a striking surface wherein said striking surface is configured to be struck by a tool for driving said tent stake into the ground, said head being distally positioned with respect to said tapered end of said tent stake, said head having a plurality of gripping elements each extending downwardly from said head wherein each of said gripping elements is configured to engage the ground when said tent stake is driven into the ground thereby inhibiting said tent stake from rotating in the ground;

wherein said tent stake has a distal end with respect to said tapered end of said tent stake;

wherein said head has a top surface, a bottom surface and a lip extending downwardly from a perimeter edge of said head, said distal end of said tent stake being attached to said bottom surface such that said top surface of said head defines said striking surface, said distal end of said tent stake being centrally positioned on said bottom surface such that said lip extends around said tent stake;

wherein said head has a plurality of teeth each extending downwardly from a bottom edge of said lip such that said plurality of teeth defines said plurality of gripping elements, each of said teeth having a first edge and a second edge each extending downwardly from said bottom edge of said lip and intersecting each other at a point; and wherein said head has a plurality of holes each extending through said top surface and said bottom surface, each of said plurality of holes being positioned between said distal end of said tent stake and said lip, said holes being evenly spaced apart from each other and being distributed around said tent stake, each of said holes having a bounding edge which as a front side and a back side, each of said front side and said back side defining a circular arc being co-arcuate with each other such that each of said holes has a curved rectangular shape.

2. The assembly according to claim 1, wherein:

said tent stake has a distal end with respect to said tapered end;

said tent stake has an upper portion and a lower portion, said upper portion being associated with said distal end, said lower portion being associated with said tapered end;

said lower portion has a plurality of ridges each extending outwardly from said tent stake, each of said plurality of ridges extending between said tapered end and said upper portion, said plurality of ridges being evenly spaced apart from each other and being distributed around said lower portion wherein said plurality of ridges is configured to inhibit said tent stake from rotating about an axis extending between said tapered end and said distal end when said tent stake is driven into the ground;

each of said ridges has an outwardly facing edge, said outwardly facing edge of each of said ridges having a first section and a second section which each curve outwardly from said lower portion and intersecting each other at a point being spaced from said tapered end, said second section of said outwardly facing edge of each of said ridges intersecting said tapered end; and said upper portion of said tent stake flares outwardly between said lower portion of said outer surface and said distal end of said tent stake.

3. The assembly according to claim 1, wherein said plurality of teeth is arranged into a plurality of sets of teeth, said sets of teeth being evenly spaced apart from each other and being distributed around said bottom edge of said lip to define a plurality of spaces between said sets of teeth wherein respective ones of said plurality of spaces is configured to accommodate a guy wire that is wrapped around said tent stake thereby facilitating said tent stake to anchor the guy wire when said tent stake is driven into the ground.

4. The assembly according to claim 1, wherein:

said tent stake has an upper portion being associated with said distal end of said tent stake; and said assembly includes a lanyard extending through said upper portion of said tent stake at a point located adjacent to said distal end, said lanyard extending outwardly through a respective pair of said holes in said head, said lanyard forming a closed loop thereby facilitating said lanyard to be gripped for pulling said tent stake outwardly from the ground.

5. A tent stake assembly for resisting being rotated or pulled from the ground while securing a tent, said assembly comprising:

a tent stake having a tapered end which tapers to a point wherein said tapered end is configured to penetrate ground, said tent stake having a distal end with respect to said tapered end, said tent stake having an upper portion and a lower portion, said upper portion being associated with said distal end, said lower portion being associated with said tapered end, said lower portion having a plurality of ridges each extending outwardly from said tent stake, each of said plurality of ridges extending between said tapered end and said upper portion, said plurality of ridges being evenly spaced apart from each other and being distributed around said lower portion wherein said plurality of ridges is configured to inhibit said tent stake from rotating about an axis extending between said tapered end and said distal end when said tent stake is driven into the ground, each of said ridges having an outwardly facing edge, said outwardly facing edge of each of said ridges having a first section and a second section which each curve outwardly from said lower portion and intersecting each other at a point being spaced from said tapered end, said second section of said outwardly facing edge of each of said ridges intersecting said tapered end, said upper portion of said tent stake flaring outwardly between said lower portion of said tent stake and said distal end of said tent stake;

a head being attached to said tent stake such that said head defines a striking surface wherein said striking surface is configured to be struck by a tool for driving said tent stake into the ground, said head being distally positioned with respect to said tapered end of said tent stake, said head having a plurality of gripping elements each extending downwardly from said head wherein each of said gripping elements is configured to engage the ground when said tent stake is driven into the ground thereby inhibiting said tent stake from rotating in the ground, said head having a top surface, a bottom surface and a lip extending downwardly from a perimeter edge of said head, said distal end of said tent stake being attached to said bottom surface such that said top surface of said head defines said striking surface, said distal end of said tent stake being centrally positioned on said bottom surface such that said lip extends around said tent stake, said head having a plurality of teeth each extending downwardly from a bottom edge of said lip such that said plurality of teeth defines said plurality of gripping elements, each of said teeth having a first edge and a second edge each extending downwardly from said bottom edge of said lip and intersecting each other at a point, said plurality of teeth being arranged into a plurality of sets of teeth, said sets of teeth being evenly spaced apart from each other and being distributed around said bottom edge of said lip to define a plurality of spaces between said sets of teeth wherein respective ones of said plurality of spaces is configured to accommodate a guy wire that is wrapped around said tent stake thereby facilitating said tent stake to anchor the guy wire when said tent stake is driven into the ground, said head having a plurality of holes each extending through said top surface and said bottom surface, each of said plurality of holes being positioned between said distal end of said tent stake and said lip, said holes being evenly spaced apart from each other and being distributed around said tent stake, each of said holes having a bounding edge which as a front side and a back side, each of said front side and said back side defining a circular arc being co-arcuate with each other such that each of said holes has a curved rectangular shape; and a lanyard extending through said upper portion of said tent stake at a point located adjacent to said distal end, said lanyard extending outwardly through a respective pair of said holes in said head, said lanyard forming a closed loop thereby facilitating said lanyard to be gripped for pulling said tent stake outwardly from the ground.

* * * * *